US009148727B1

(12) United States Patent
Busenitz

(10) Patent No.: US 9,148,727 B1
(45) Date of Patent: Sep. 29, 2015

(54) NON-AXISYMMETRIC GEOMETRY FOR CLOTH LOUDSPEAKER SUSPENSIONS

(71) Applicant: Bose Corporation, Framingham, MA (US)

(72) Inventor: John Busenitz, Clinton, MA (US)

(73) Assignee: Bose Corporation, Framingham, MA (US)

( * ) Notice: Subject to any disclaimer, the term of this patent is extended or adjusted under 35 U.S.C. 154(b) by 28 days.

(21) Appl. No.: 14/219,925

(22) Filed: Mar. 19, 2014

(51) Int. Cl.
*H04R 7/16* (2006.01)
*H04R 9/02* (2006.01)
*H04R 7/02* (2006.01)

(52) U.S. Cl.
CPC .. *H04R 7/16* (2013.01); *H04R 7/02* (2013.01); *H04R 9/02* (2013.01)

(58) Field of Classification Search
CPC .... H04R 9/00; H04R 29/003; H04R 2209/00; H04R 2209/41; H04R 7/00; H04R 2207/00; H04R 7/06; H04R 2307/029
USPC ..... 381/398, 404, 423–424, 428
See application file for complete search history.

(56) References Cited

U.S. PATENT DOCUMENTS

| | | | | |
|---|---|---|---|---|
| 2,020,705 | A | 11/1935 | Stenger | |
| 2,997,549 | A | 8/1961 | Hassan | |
| 3,961,378 | A | 6/1976 | White | |
| 5,619,019 | A | 4/1997 | Yoshimura et al. | |
| 5,878,150 | A * | 3/1999 | Okazaki et al. | 381/404 |
| 6,851,513 | B2 | 2/2005 | Stead et al. | |
| 7,174,990 | B2 | 2/2007 | Stead et al. | |
| 7,274,796 | B2 * | 9/2007 | Chan | 381/404 |
| 7,382,892 | B2 * | 6/2008 | Chan | 381/404 |
| 7,397,927 | B2 | 7/2008 | Pircaro et al. | |
| 7,568,552 | B2 | 8/2009 | Litovsky et al. | |
| 8,139,812 | B2 | 3/2012 | Basnet et al. | |
| 2013/0308815 | A1 | 11/2013 | Alvarez | |

FOREIGN PATENT DOCUMENTS

| | | | |
|---|---|---|---|
| CN | 103618979 | A | 3/2014 |
| EP | 0836362 | A1 | 4/1998 |
| EP | 2451192 | A1 | 5/2012 |

(Continued)

OTHER PUBLICATIONS

Seidel, G., "NP-001: Reformatted and Revised", ALMA, The International Loudspeaker Association, Feb. 4, 2004; 4 pages.

(Continued)

*Primary Examiner* — Suhan Ni
(74) *Attorney, Agent, or Firm* — Schmeiser, Olsen & Watts LLP

(57) ABSTRACT

A suspension element used in an acoustic apparatus includes a woven fabric made of warp thread and weft thread. The warp thread extends parallel to a first major axis of the woven fabric and the weft threads extend parallel to a second major axis of the woven fabric orthogonal to the first major axis. The woven fabric further includes an inner periphery and an outer periphery. At least one of the inner and outer peripheries has a shape having one of four-fold rotational symmetry and dihedral symmetry. The shape produces a shorter distance between the inner and outer peripheries along a minor axis of the woven fabric that extends radially between the first and second major axes than a distance between the inner and outer peripheries along at least one of the first and second major axes.

31 Claims, 8 Drawing Sheets

(56) References Cited

FOREIGN PATENT DOCUMENTS

| | | | |
|---|---|---|---|
| JP | S61158297 | A | 7/1986 |
| JP | 2995454 | B2 | 12/1999 |
| JP | 2000092591 | A | 3/2000 |
| JP | 2006352276 | A | 12/2006 |

OTHER PUBLICATIONS

Seidel, G., "NP-004: Reformatted and Revised", ALMA, The International Loudspeaker Association, Feb. 4, 2004; 2 pages.

International Search Report & Written Opinion in related International Patent Application No. PCT/US15/20960, mailed on Jun. 12, 2015; 12 pages.

* cited by examiner

NON-AXISYMMETRIC GEOMETRY FOR CLOTH LOUDSPEAKER SUSPENSIONS

BACKGROUND

The present disclosure relates generally to electroacoustic transducers, including loudspeakers, and more specifically, to geometries of suspension elements used in electroacoustic transducers.

SUMMARY

All examples and features mentioned below can be combined in any technically possible way.

In one aspect, a suspension element for an acoustic apparatus is provided. The suspension element includes a woven fabric comprising warp thread and weft thread. The warp thread extends parallel to a first major axis of the woven fabric and the weft thread extends parallel to a second major axis of the woven fabric orthogonal to the first major axis. The woven fabric further comprises an inner periphery and an outer periphery. At least one of the inner and outer peripheries has a shape with one of four-fold rotational symmetry and dihedral symmetry. The shape of the at least one of the inner and outer peripheries produces a shorter distance between the inner and outer peripheries along a minor axis of the woven fabric that extends radially between the first and second major axes than a distance between the inner and outer peripheries along at least one of the first and second major axes.

Embodiments of the suspension element may include one of the following features, or any combination thereof.

The suspension element may be a surround or a spider. The shape of the suspension element may be of a superellipse or a squircle. The at least one of the inner and outer peripheries having the shape with one of four-fold rotational symmetry and dihedral symmetry includes the outer periphery, the inner periphery, or both. When the outer periphery has the shape of one of four-fold rotational symmetry and dihedral symmetry, the inner periphery may be circular in shape. When the inner periphery has the shape of one of four-fold rotational symmetry and dihedral symmetry, the outer periphery may be circular in shape. When both the inner and outer peripheries have the shape of one of four-fold rotational symmetry and dihedral symmetry, the shape of each periphery may have a plurality of outwardly curved corners. Each outwardly curved corner of one of the peripheries may be approximately on the minor axis, and each outwardly curved corner of the other of the peripheries is approximately on at least one of the first and second major axes. The woven fabric may be a plain-weave cloth.

In another aspect, an acoustic apparatus comprises a frame and a suspension element with a first woven fabric comprising warp thread and weft thread. The warp thread extends parallel to a first major axis of the first woven fabric and the weft thread extends parallel to a second major axis of the first woven fabric orthogonal to the first major axis. The first woven fabric further comprises an inner periphery and an outer periphery coupled to the frame. At least one of the inner and outer peripheries has a shape with one of four-fold rotational symmetry and dihedral symmetry. The shape of the at least one of the inner and outer peripheries produces a shorter distance between the inner and outer peripheries along a minor axis that extends radially between the first and second major axes than a distance between the inner and outer peripheries along at least one of the first and second major axes.

Embodiments of the apparatus may include one of the following features, or any combination thereof.

The suspension element of the apparatus may be a surround or a spider. The shape of the suspension element may be of a superellipse or a squircle. The at least one of the inner and outer peripheries having the shape with one of four-fold rotational symmetry and dihedral symmetry includes the outer periphery, the inner periphery, or both. When the outer periphery has the shape of one of four-fold rotational symmetry and dihedral symmetry, the inner periphery may be circular in shape. When the inner periphery has the shape of one of four-fold rotational symmetry and dihedral symmetry, the outer periphery may be circular in shape. When both the inner and outer peripheries have the shape of one of four-fold rotational symmetry and dihedral symmetry, the shape of each periphery may have a plurality of outwardly curved corners. Each outwardly curved corner of one of the peripheries may be approximately on the minor axis, and each outwardly curved corner of the other of the peripheries is approximately on at least one of the first and second major axes. The woven fabric may be a plain-weave cloth.

Further, the acoustic apparatus may further comprise a second suspension element with a second woven fabric comprising warp thread and weft thread. The warp thread of the second woven fabric extending parallel to a first major axis of the second woven fabric and the weft thread of the second woven fabric extending parallel to a second major axis of the second woven fabric orthogonal to the first major axis of the second woven fabric. The second woven fabric further comprises an inner periphery and an outer periphery. At least one of the inner and outer peripheries of the second woven fabric has a shape with one of four-fold rotational symmetry and dihedral symmetry. The shape produces a distance between the inner and outer peripheries of the second woven fabric along a minor axis of the second woven fabric extending radially between the first and second major axes of the second woven fabric that is shorter than a distance between the inner and outer peripheries of the second woven fabric along at least one of the first and second major axes of the second woven fabric. One of the suspension elements may a surround and the other of the suspension elements may be a spider.

In another aspect, an electronics system comprises an acoustic apparatus with a frame and a suspension element. The suspension element comprises a woven fabric comprising warp thread and weft thread. The warp thread extends parallel to a first major axis of the woven fabric and the weft thread extends parallel to a second major axis of the woven fabric orthogonal to the first major axis. The woven fabric further comprises an outer periphery coupled to the frame. The outer periphery has a shape with one of four-fold rotational symmetry and dihedral symmetry. The shape produces a shorter distance along a minor axis of the woven fabric that extends radially between the first and second major axes than a distance along at least one of the first and second major axes. The suspension element of the acoustic apparatus may be a surround or a spider, and the shape of the suspension element may be of a superellipse or a squircle.

BRIEF DESCRIPTION OF THE DRAWINGS

The above and further features and advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
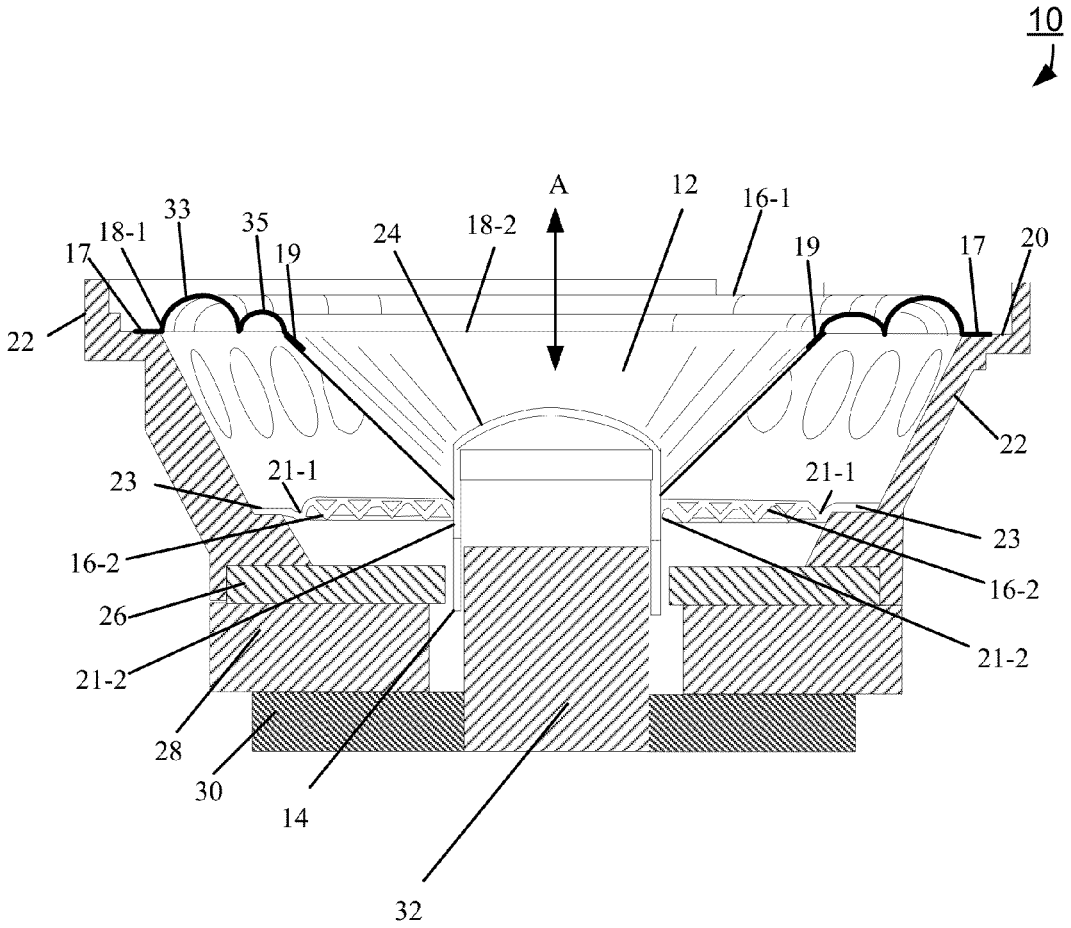
FIG. 1 is a cross-sectional view of an example of an acoustic apparatus, such as a loudspeaker.

FIG. 1 shows a cross-sectional view of an example of an acoustic apparatus 10 (e.g., a loudspeaker), including a diaphragm 12, sometimes referred to as a cone, connected to a voice coil 14. A first suspension element 16-1, sometimes referred to as a surround, has a roll outer periphery 18-1 and a roll inner periphery 18-2. The roll outer periphery 18-1 may refer to the edge of an active region at or near the outer edge of the outermost roll 33 of the surround 16-1. Similarly, the roll inner periphery 18-2 may refer to the edge of an active region at or near the inner edge of the innermost roll 35 of the surround 16-1. The surround 16-1 also has a flange 17 that attaches the roll outer periphery 18-1 to an annular mounting flange 20 of a fixed frame (or basket) 22 and a flange 19 that attaches the roll inner periphery 18-2 to an outer edge of the diaphragm 12. The roll outer periphery 18-1 and roll inner periphery 18-2 effectively define a boundary between the active region of the surround 16-1 and the mounting flanges 17 and 19, respectively.

The surround 16-1 may be made from a flexible material, including, but not limited to, fabric, rubber, foam, or polyurethane plastic, such as thermoplastic polyurethane. The surround 16-1 may be, for example, a circular half roll having a single convolution, a full roll, an inverted half roll, (i.e., flipped over 180 degrees), or a roll having multiple convolutions (as shown in FIG. 1). A convolution as used herein comprises one cycle of a possibly repeating structure, where the structure typically comprises concatenated sections of arcs. The arcs are generally circular, but can have any curvature. As will be described herein, each of the roll outer periphery 18-1 and roll inner periphery 18-2 of the surround 16-1 may have a circular shape or a shape having n-fold rotational symmetry or dihedral symmetry (e.g., a superellipse, squircle, etc.).

A second suspension element 16-2, referred to as a spider or damper, has a cup outer periphery 21-1 that attaches to the frame 22 via a land 23, and a neck inner periphery 21-2 that attaches to the voice coil 14, the diaphragm 12, or both. The cup outer periphery 21-1 may correspond to the edge of an active region at or near the outer edge of the outermost convolution of the spider 16-2. The neck inner periphery 21-2 may correspond to the edge of an active region at or near the inner edge of the innermost convolution of the spider 16-2. The spider 16-2 may also be made from a flexible material, including, but not limited to, fabric, rubber, foam, or polyurethane plastic, such as thermoplastic polyurethane. The spider 16-2 may have the shape of a corrugated disk or the like, or otherwise include a set of convolutions that permit the voice coil 14 to move axially, i.e., along axis A in FIG. 1. As described further herein, each of the cup outer periphery 21-1 and neck inner periphery 21-2 of the spider 16-2 may have either a circular shape or a shape having n-fold rotational symmetry or dihedral symmetry (e.g., a superellipse, squircle, etc.).

In another example, the spider 16-2 does not include a central opening, but instead includes a central region at which a dust cap or the like may be integrated or otherwise coupled at the central region of the spider 16-2. Here, a voice coil may be coupled, for example, glued, to the spider 16-2 by a butt joint or the like, instead of a thru-joint or the like typically provided in configurations where the spider 16-2 has a central opening. In this example, the cup outer periphery 21-1 of the spider 16-2 may have a shape having n-fold rotational symmetry or dihedral symmetry (e.g., a superellipse, squircle, etc.).

A dust cap 24 may be disposed central to the diaphragm 12 to protect the voice coil 14 and neighboring regions. A top plate 26, permanent magnet 28, and bottom plate 30 produce a magnetic field within which the voice coil 14 is suspended. The voice coil 14 wraps about a pole piece 32 (with an air gap therebetween).

During operation of the loudspeaker, an electrical current produced from an audio signal flows through the voice coil 14. When the electrical current in the voice coil 14 changes direction, the magnetic forces between the voice coil 14 and the permanent magnet 28 also change, causing the voice coil 14 to move up and down. This up-and-down movement of the voice coil 14 pushes and pulls on the diaphragm 12. The surround 16-1 and spider 16-2 are made from a flexible material, such as a woven fabric, that allows the diaphragm 12 to vibrate, while providing a restoring force that helps bring the diaphragm 12 back to a rest position when the voice coil 14 is not being driven. Either or both the surround 16-1 and spider 16-2 may be impregnated, in whole or in part, with a stiffening resin, and/or selectively softened with a post-resin application of a softening material, for example, rubber. Example techniques for selectively softening areas of either or both a surround and a spider with a post-resin softening treatment can be found in U.S. patent application Ser. No. 14/161,008, filed on Jan. 22, 2014, titled, "Treatment for Loudspeaker Suspension Element," the entirety of which application is incorporated by reference herein. In addition, these two suspension elements 16-1, 16-2 (generally, 16) cooperate to restrict movement of the diaphragm 12 to the up-and-down movement, as indicated by arrow A. Making the shape of one or both of the two suspension elements 16 a shape that has n-fold rotational symmetry or dihedral symmetry (e.g., a superellipse, squircle, etc.) is designed to equalize the distribution of stress around the given suspension element.

The suspension elements described above may be formed of woven cloth or related material. Examples of weaves include, but are not limited to, a plain weave, twill weave, satin weave, herringbone weave, honeycomb weave, tri-axial weave, or a combination thereof. Such woven cloth suspensions generally have pseudo-orthotropic properties due to the weave construction of the cloth, which means the mechanical properties of the cloth vary along different axes of the cloth. For instance, woven cloth used in a loudspeaker suspension element, such as a surround or a spider, has a higher elastic modulus along the warp and weft thread than off-axis (i.e., off those axes defined by the fabric pattern of the warp and weft thread). Assuming a constant overall cloth thickness, the warp and weft threads have a higher stiffness than the off-axis portions due to their higher elastic modulus. Consequently, the regions of the suspension element along the warp and weft threads of the fabric have an unequal share in providing stiffness and in bearing stress. Shape distortion of the suspension element may result. Such distortion may be sufficiently prominent during large excursion to cause dynamic contact (i.e., soft bottoming).

Figure 2:
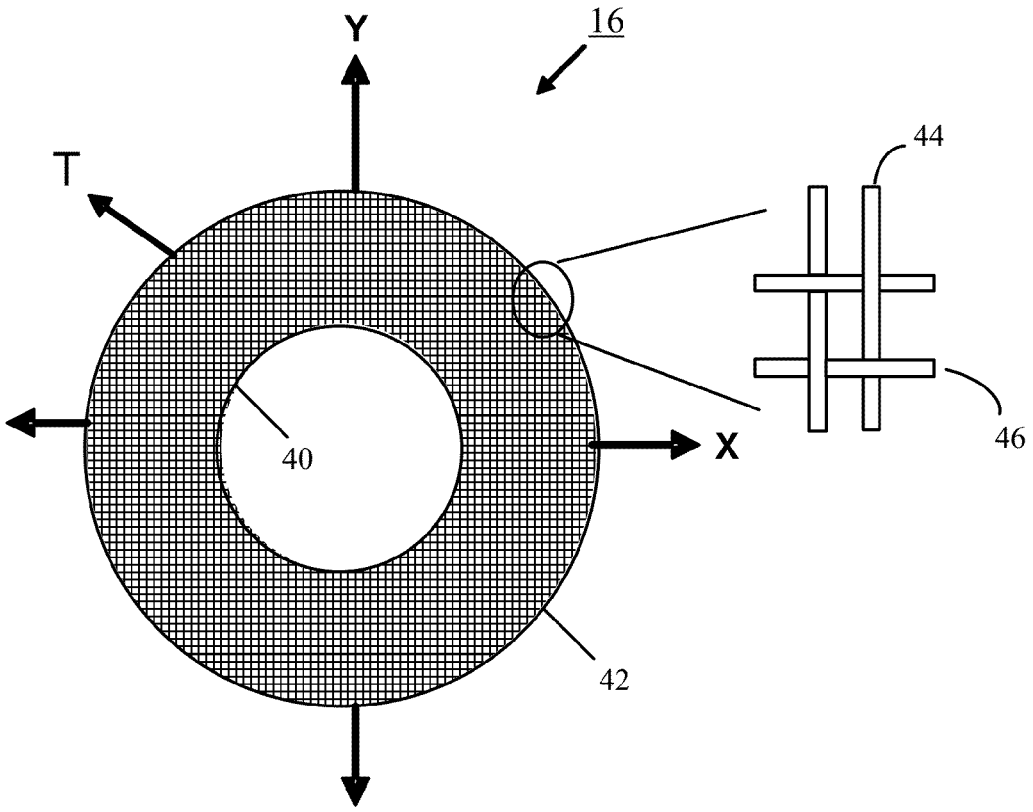
FIG. 2 is a plan view of an example of a suspension element used in an acoustic apparatus.

These principles can be further illustrated with reference to FIG. 2. FIG. 2 shows generally a suspension element 16 (i.e., surround or spider) having a donut shape with an inner periphery 40 and an outer periphery 42. In the instance of a surround, the inner periphery 40 is coupled to the outer periphery of the diaphragm 12 and the outer periphery 42 is coupled to a frame; in the instance of a spider, the inner periphery 40 is coupled to the outer periphery of the voice coil 14 and the outer periphery 42 is coupled to the frame. The suspension element 16 comprises meshed warp and weft threads 44, 46, respectively, which produce a weave. Examples of weaves include, but are not limited to, a plain weave, twill weave, satin weave, herringbone weave, honeycomb weave, tri-axial weave, or a combination thereof. Warp and weft threads can be made of cotton, polyester, nylon, cellulose, polymers, aramids, fiber composites, such as elastomers, materials having the same, similar, or related properties, or a combination thereof. Warp and weft threads can comprise monofilament fibers (fibers that have only one filament), bunched monofilament fibers (two or more monofilament fibers that are aggregated as one fiber), staple fibers (fibers that include filaments that are shorter than the length of the fiber that are twisted or spun to form a multifilament fiber), or any combination thereof. For purposes of illustrating the principles described herein, the y-axis is parallel to the warp threads 44, and the x-axis is parallel to the weft threads 46. The x- and y-axes are referred to herein as "major axes."

In response to an applied stretching force, the suspension element 16 deforms along the x-axis (i.e., the weft 46) to a similar degree as it deforms along the y-axis (i.e., the warp 44). However, the deformation of the suspension element 16 along intermediate axes between the x- and y-axes, for example, along axis T, is slight in comparison to the deformations along the warp 44 and the weft 46. Consequently, the stretching force tends to pull taut weft and warp threads along the x and y-axes, respectively, whereas the fabric around the intermediate axes remains relatively slack. Intermediate axes may be referred to herein as "minor axes" or as being "off-axis." To illustrate quantitatively, if one were to normalize the degree of deformation to the deformation along the warp 44 (valued at 1), the deformation along the weft 46 might be approximately 0.8 to 1, whereas the deformation along a minor axis (i.e., off-axis), such as axis T, might be approximately 0.2. This unbalanced degree of deformation around the suspension element 16 may negatively affect the sound quality of the acoustic apparatus 10.

Various examples of geometries for suspension elements are described herein to complement the non-axisymmetric material properties of woven fabric. In brief overview, at least one of an inner and outer periphery of the suspension element has a shape having n-fold rotational symmetry or dihedral symmetry (e.g., a superellipse, squircle, etc.). N-fold rotational symmetry may refer to a shape that does not change when rotated by 360°/n. For example, four-fold rotational symmetry refers to a shape that does not change when rotated by 90°. Dihedral symmetry may refer to a shape that has n-fold rotational symmetry about one axis and 2-fold rotational symmetry about a perpendicular axis. One example of a suitable shape is a superellipse which can be described by the following Cartesian equation:

$$|x/a|^n+|y/b|^n=1; \qquad \text{Eq. (1)}$$

where n, a, and b are positive numbers, and the superellipse curve is bounded by the rectangle $-a \le x \le a$ and $-b \le y \le b$.

One generalization of the superellipse curve is:

$$|x/a|^n+|y/b|^m=1; \qquad \text{Eq. (2)}$$

where m, n, a, and b are positive numbers, and the superellipse curve is bounded by the rectangle $-a \le x \le a$ and $-b \le y \le b$.

Another generalization of the superellipse curve, known as Johan Gielis's "superformula", uses polar coordinates:

$$r(\phi)=[|\cos(m\phi/4)/a|^{n2}+[|\sin(m\phi/4)/b|^{n3}]^{-1/n1}; \qquad \text{Eq. (3).}$$

where m, n1, n2, n3, a, and b are positive numbers, r is the radius of the curve, an $\phi$ the angle.

As described herein, applying a shape having n-fold rotational symmetry or dihedral symmetry to an inner and/or outer periphery of a suspension element may produce a distance between the inner and outer peripheries of the suspension element along a minor axis (i.e., off-axis) that is shorter than the distance between the inner and outer peripheries along the major axes defined by the fabric pattern of the warp and weft. The difference in distances operates to approximately equalize the axial stiffness and effective free length (pull up) on a radial basis (i.e., traversing around the suspension element). Advantageously, this equalization can result in increased suspension linearity and travel for a given overall suspension area, increased durability of the suspension element because of a more equal distribution of actual stress, an avoidance or reduction in radial shape distortion inherent in plain-weave suspension elements, and, for some loudspeaker driver designs, an increased radiating area for surrounds without increasing the size of the effective packaging "envelope."

Figure 3:
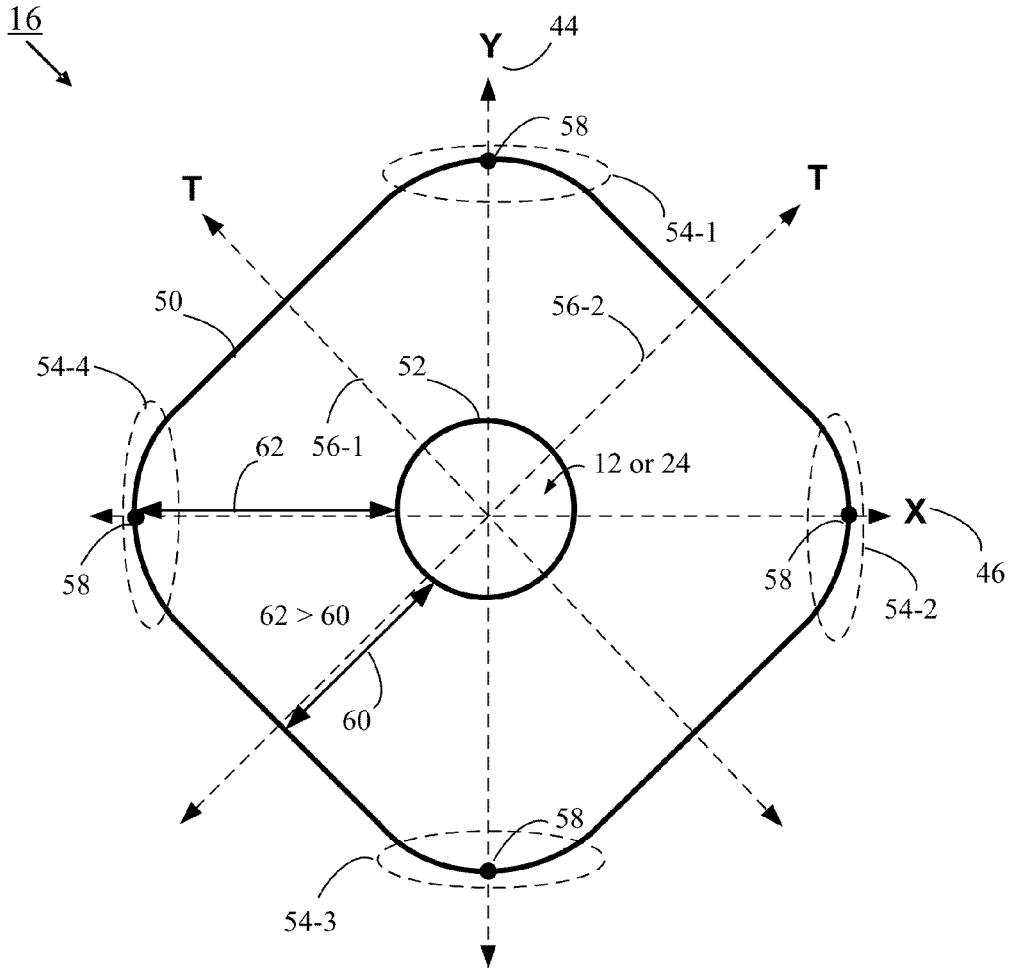
FIG. 3 is a plan view of another example of a suspension element with an inner periphery that is circular in shape and an outer periphery that has a shape having four-fold rotational symmetry.

FIG. 3 shows a plan view of an example of a suspension element 16 adapted to balance the unbalanced deformation tendencies inherent in a woven fabric. In this example, the warp threads of the woven fabric of the suspension element 16 are parallel to the y-axis 44, and the weft threads are parallel to the x-axis 46. The suspension element 16 includes an inner periphery 52 that is circular in shape and an outer periphery 50 that has a shape having four-fold rotational symmetry. In the example of FIG. 3, that shape is a squircle, which is a special case of a superellipse curve, mathematically defined by the equation $x^4+y^4=r^4$ In other examples, the shape of the outer periphery 50 could be a superellipse or other shapes having n-fold rotational symmetry, or shapes having dihedral symmetry, such as a rhombus, diamond, or lozenge.

In the instance that the suspension element 16 is a surround 16-1, the outer periphery 50 and inner periphery 52 correspond to the roll outer periphery 18-1 and roll inner periphery 18-2, respectively; in the instance of a spider 16-2, the outer periphery 50 and inner periphery 52 correspond to the cup outer periphery 21-1 and neck inner periphery 21-2, respectively. In this example of the suspension element 16, the inner periphery 52 is circular to accommodate conventional assembly methods of the diaphragm 12 (in the instance the suspension element 16 is a surround 16-1) or of the voice coil 14 (in the instance the suspension element 16 is a spider 16-2). The inner periphery 52 could be other shapes, however, including but not limited to an ellipse, toroid, square, rectangle, oblong, racetrack, or other non-circular shapes, or a combination thereof.

The shape of the outer periphery 50 has a plurality of arcs 54-1, 54-2, 54-3, and 54-4 (generally, 54). Such arcs 54 may be referred to as convex or outwardly curved corners. Each arc 54 appears in a different quadrant of the suspension element 16, and is generally parabolic in shape. The major x- and y-axes intersect the arcs 54 at vertices 58 at approximately the center of each arc 54. The center of each arc 54 may be at other positions other than on one of the x- and y-axes. Radial axes (T) of symmetry 56-1, 56-2 (generally, 56) are intermediate between the major x- and y-axes. Each radial axis of symmetry 56 approximately bisects a 90-degree angle between the x-axis 46 and y-axis 44 approximately on a 45-degree line (±4.5 degrees). Moving in clockwise order around the suspension element 16, starting at the y-axis 46, these 45-degree lines (or minor axes T) may also be referred to as the 45° line, 135° line, 225° line, and 315° line. In the example shown in FIG. 3, the portions of the outer periphery 50 in between the arcs 54 are shown as being straight, but they could be curved in other examples.

The squircle shape shown in FIG. 3 applies to at least a portion of the active region of the suspension element 16. For a spider 16-2 with multiple convolutions, the outermost convolution (i.e., the cup outer periphery 21-1) has the squircle shape, and the inner convolutions transition from the squircle shape to the innermost convolution (i.e., a neck inner periphery 21-2) with a substantially circular shape. For a surround 16-1 with a half-roll, the roll outer periphery 18-1 has the squircle shape, the apex of the roll has a circular shape or a squircle shape that is almost circular, and the roll inner periphery 18-2 has a substantially circular shape.

Figure 4:
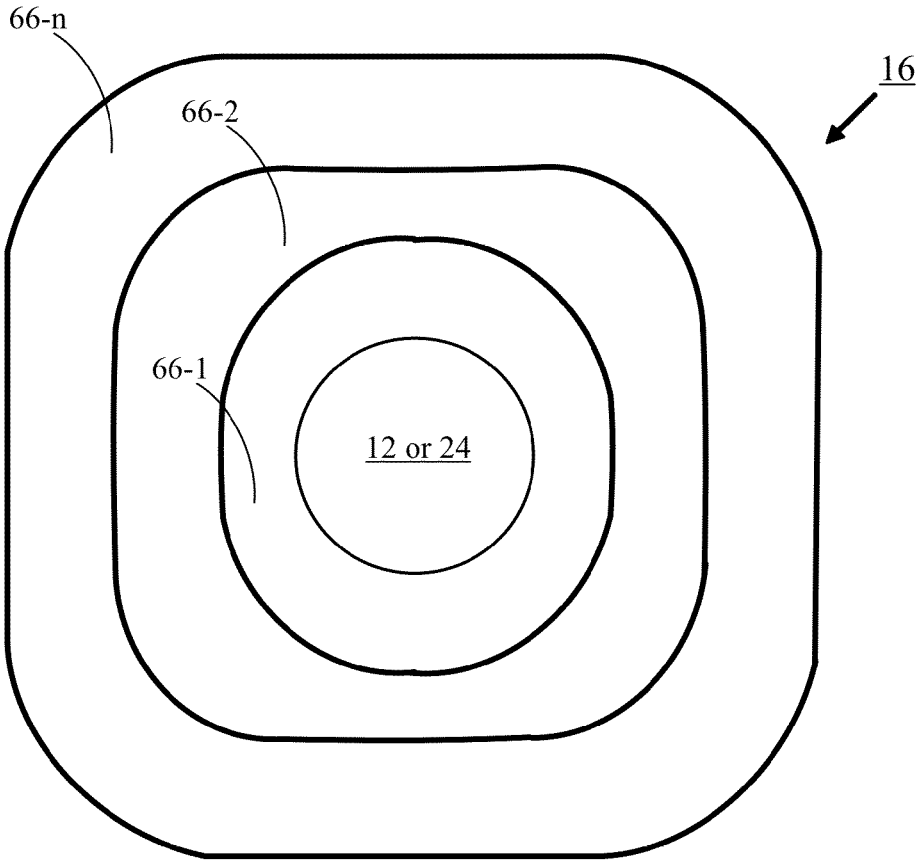
FIG. 4 is a plan view of another example of a suspension element, wherein the convolutions surrounding the central region or opening gradually transition in shape, from the innermost convolution having a circular or near-circular shape to the outermost convolution having a squircle shape.

FIG. 4 illustrates an example of a suspension element 16 wherein the convolutions surrounding the central region or opening (12 or 24) gradually transition in shape, from the innermost convolution 66-1 having a circular or near-circular shape to the outermost convolution **66-*n* having a squircle shape. An intermediate convolution 66-2 between the innermost and outermost convolutions may have an intermediate shape, that is, a shape that is more circular than the outermost convolution 66-*n*, while more squircular than the innermost convolution 66-1**.

Figure 5:
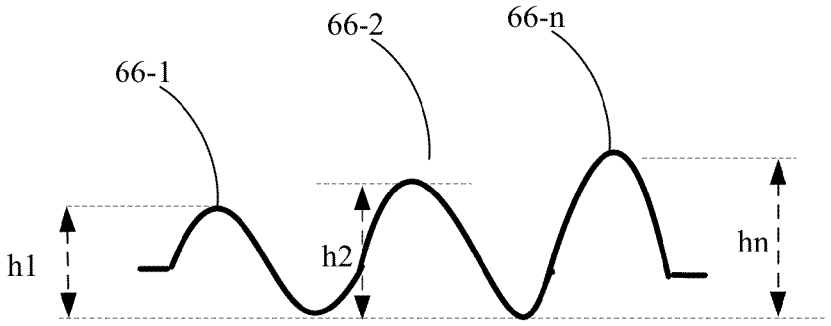
FIG. 5 is a cross-sectional view of an example of the convolutions of the suspension element of FIG. 4 and their corresponding peak-to-peak heights.

The convolutions 66-1, 66-2, **66-*n* (generally, 66) can have different peak-to-peak heights, although the height of each given convolution 66 is constant all the way around the central opening or region. In addition, there are no partial convolutions; that is, each convolution completes a full circuit about the central opening or region such that the number of convolutions is constant all the way around. For example, FIG. 5 shows a cross-section of the convolutions 66-1, 66-2, and 66-*n* and their corresponding peak-to-peak heights h1, h2, and hn, respectively. In this example, the innermost (half) convolution 66-1 has the shortest peak-to-peak height h1, the outermost convolution 66-*n* has the greatest height hn, and the intermediate convolution 66-2 has an intermediate height h2**.

Returning to the example of FIG. 3, the shape of the squircle is adapted to produce a distance 60 from the inner periphery (i.e., roll inner periphery 18-2 or neck inner periphery 21-2 of a surround or spider, respectively) to the outer periphery (i.e., roll outer periphery 18-1 or cup outer periphery 21-1 of a surround or spider, respectively) along the minor intermediate axes 56 that is shorter than the distance 62 between the inner periphery and the outer periphery along a major axis (x or y). The shorter distances 60 along the minor intermediate axes 56 (which are generally not as stiff as the major x and y-axes) have the effect of approximately equalizing the axial stiffness and effective free length around the suspension element 16.

Figure 6:
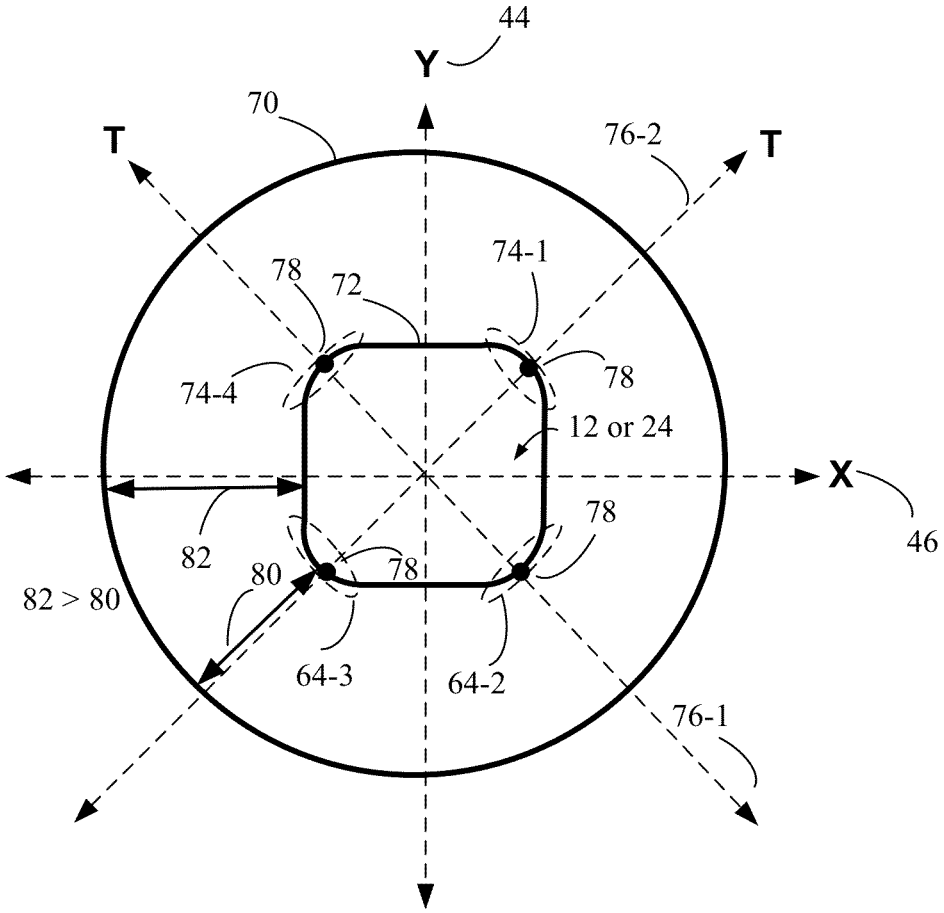
FIG. 6 is a plan view of another example of a suspension element with an outer periphery that is circular in shape and an inner periphery that has a shape having four-fold rotational symmetry.

FIG. 6 shows a plan view of an example of a suspension element 16 with an outer periphery 70 that is circular in shape and an inner periphery 72 that has a shape having four-fold rotational symmetry. The outer periphery 70 could be non-circular in shape, however, including but not limited to an ellipse, toroid, square, rectangle, oblong, racetrack, or other non-circular shapes, or a combination thereof. The shape of the inner periphery 72 corresponds to a squircle in FIG. 6, but in other examples, could be a superellipse or other shapes having n-fold rotational symmetry, or shapes having dihedral symmetry, such as a rhombus, diamond or lozenge. In the instance that the suspension element 16 is a surround 16-1, the outer periphery 70 and inner periphery 72 correspond to the roll outer periphery 18-1 and roll inner periphery 18-2, respectively; in the instance of a spider 16-2, the outer periphery 70 and inner periphery 72 correspond to the cup outer periphery 21-1 and neck inner periphery 21-2, respectively. As in the prior examples, the warp threads of the woven fabric of the suspension element 16 are parallel to the y-axis 44, and the weft threads are parallel to the x-axis 46.

The inner periphery 72 of this example of suspension element 16 has a plurality of arcs 74-1, 74-2, 74-3, and 74-4 (generally, 74). These arcs 74 may also be referred to as convex or outwardly curved corners. Each arc 74 appears in a different quadrant of the suspension element 16, and is generally parabolic in shape. Axes of symmetry 76-1, 76-2 (generally, 76) intersect the arcs 74 at vertices 78 (i.e., approximately the middle of the arc). Each axis of symmetry 76 is an intermediate axis that approximately bisects the 90-degree angle between the x-axis 44 and y-axis 46. Thus, the center of each arc 74 is approximately on a 45-degree line (±4.5 degrees) between a 90-degree angle formed by the x- and y-axes. However, the center of each arc 54 could be at other positions between the 90-degree angle formed by the x- and y-axes. In the example shown in FIG. 6, the portions of the inner periphery 72 in between the arcs 74 are shown as being straight, but they could be curved in other examples.

The squircle shape shown in FIG. 6 applies to at least a portion of the active region of the suspension element 16. For a spider 16-2 with multiple convolutions (e.g., FIG. 4), the innermost convolution (i.e., the neck outer periphery 21-2) has the squircle shape, and the inner convolutions transition from the squircle shape to the outermost convolution (i.e., a cup inner periphery 21-1) with a substantially circular shape. For a surround 16-1 with a half-roll, the roll inner periphery 18-2 has the squircle shape, the apex of the roll 32 has a circular shape or a squircle shape that is almost circular, and the roll outer periphery 18-1 has a substantially circular shape.

The shape of the inner periphery 72 is adapted such that the distance 80 from the inner periphery (i.e., roll inner periphery 18-2 or neck inner periphery 21-2 of a surround or spider, respectively) to the outer periphery (i.e., roll outer periphery 18-1 or cup outer periphery 21-1 of a surround or spider, respectively) along the minor intermediate axes 76 is shorter than the distance 82 between the inner periphery 72 and the outer periphery 70 along a major axis (x or y). The effect of the distances 80 along minor intermediate axes 76 being shorter than the distances 82 along major axes is to approximately equalize the axial stiffness and effective free length around the suspension element 16.

Figure 7:
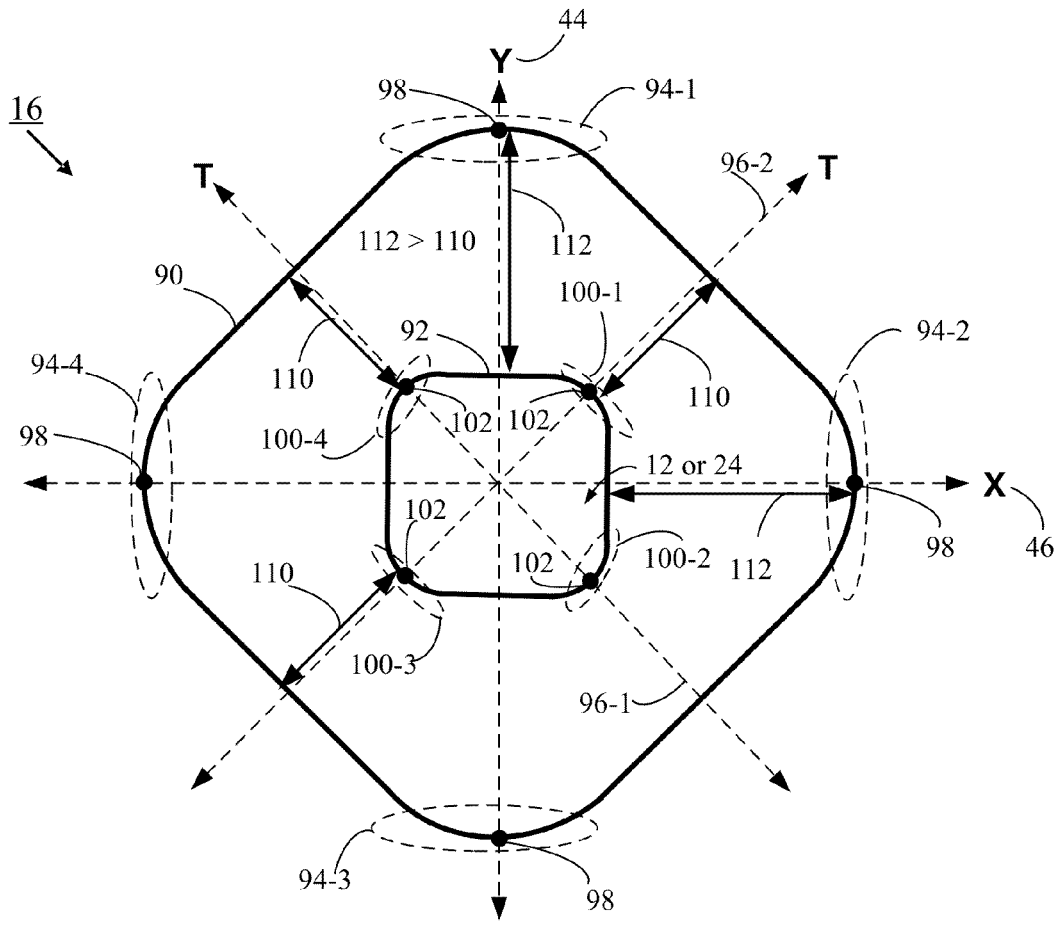
FIG. 7 is a plan view of another example of a suspension element with both inner and outer peripheries having a shape having four-fold rotational symmetry.

FIG. 7 shows a plan view of an example of a suspension element 16 with an outer periphery 90 and inner periphery 92, each having a shape having four-fold rotational symmetry. In the instance the suspension element 16 is a surround 16-1, the outer periphery 90 and inner periphery 92 correspond to the roll outer periphery 18-1 and roll inner periphery 18-2, respectively; in the instance of a spider 16-2, the outer periphery 90 and inner periphery 92 correspond to the cup outer periphery 21-1 and neck inner periphery 21-2, respectively. Again, for purposes of illustration, the warp threads of the woven fabric of the suspension element 16 are parallel to the y-axis 44; the weft threads are parallel to the x-axis 46.

In this example, each of the peripheries 90, 92 has the shape of a squircle. In other examples, the shape of the inner and outer peripheries 90, 92 could be a superellipse or other shapes having n-fold rotational symmetry, or shapes having dihedral symmetry, such as a rhombus, diamond or lozenge. The outer periphery 90 has a plurality of arcs 94-1, 94-2, 94-3, and 94-4 (generally, 94). Such arcs 94 may also be referred to as convex or outwardly curved corners. Each arc 94 appears in a different quadrant of the suspension element 16, and is generally parabolic in shape. The major x- and y-axes intersect the arcs 94 at vertices 98 at approximately the center of each arc 94. The center of each arc 94 may be at other positions other than on one of the x- and y-axes. Radial axes (T) of symmetry 96-1, 96-2 (generally, 96) are intermediate between the major x- and y-axes. Each axis of symmetry 96 approximately bisects a 90-degree angle between the x-axis 46 and y-axis 44, approximately on a 45-degree line (±4.5 degrees). In the example shown in FIG. 7, the portions of the outer periphery 90 in between the arcs 94 are shown as being straight, but they could be curved in other examples.

The inner periphery 92 of this example of the suspension element 16 also has a plurality of arcs 100-1, 100-2, 100-3, and 100-4 (generally, 100). These arcs 100 may also be referred to as convex or outwardly curved corners. Each arc 100 appears in a different quadrant of the suspension element 16, and is generally parabolic in shape. The minor axes 96-1, 96-2 intersect the arcs 100 at vertices 102 (i.e., approximately the middle of the arc); the center of each arc 100 is approximately on one of the minor axes 96-1, 96-2. The shape of the inner periphery 92 is similar to the shape of the outer periphery 90 (both being squircles, though other shapes having n-fold rotational symmetry or dihedral symmetry could be used), with the orientation of the arcs 100 of the inner periphery 92 being turned 45 degrees relative to arcs 94 of the outer periphery 90. In the example shown in FIG. 7, the portions of the inner periphery 92 in between the arcs 94 are shown as being straight, but they could be curved in other examples.

Although described in connection with the peripheries 90, 92, the shapes having n-fold rotation symmetry or dihedral symmetry apply to at least a portion of the active region of the suspension element 16. For a spider 16-2 with multiple convolutions (e.g., FIG. 4), the outermost convolution (i.e., the cup inner periphery 21-1) has the squircle shape of the outer periphery 90, with the inner convolutions transitioning towards a substantially circular shape, and the innermost convolutions (i.e., neck inner periphery 21-2) approaching the squircle shape of the inner periphery 92. For a surround 16-1 with a half-roll, the roll outer periphery 18-1 has the squircle shape of the outer periphery 90, the apex of the roll 32 approximates a circular shape, and the roll inner periphery 18-2 has the squircle shape of the inner periphery 92.

The shapes of the outer periphery 90 and inner periphery 92 do not need to be similar or the same in shape, nor does the orientation of the arcs 100 of the inner periphery 92 need to be turned 45 degrees relative to the arcs 94 of the outer periphery 90. Determinative, rather, for approximately equalizing the axial stiffness and effective free length around the suspension element 16, is that the length of fabric in the active regions be shorter along the minor axes (96-1, 96-2) than along the major axes (44, 46). For instance, the equalization is achieved by having the distance 110 from the inner periphery (i.e., roll inner periphery 18-2 or neck inner periphery 21-2 of a surround or spider, respectively) to the outer periphery (i.e., roll outer periphery 18-1 or cup outer periphery 21-1 of a surround or spider, respectively) along each minor axis 96-1, 96-2 be shorter than the distance 112 from the inner periphery to the outer periphery along each major axis 44, 46, which, by definition, coincides with either the warp and the weft.

Figure 8:
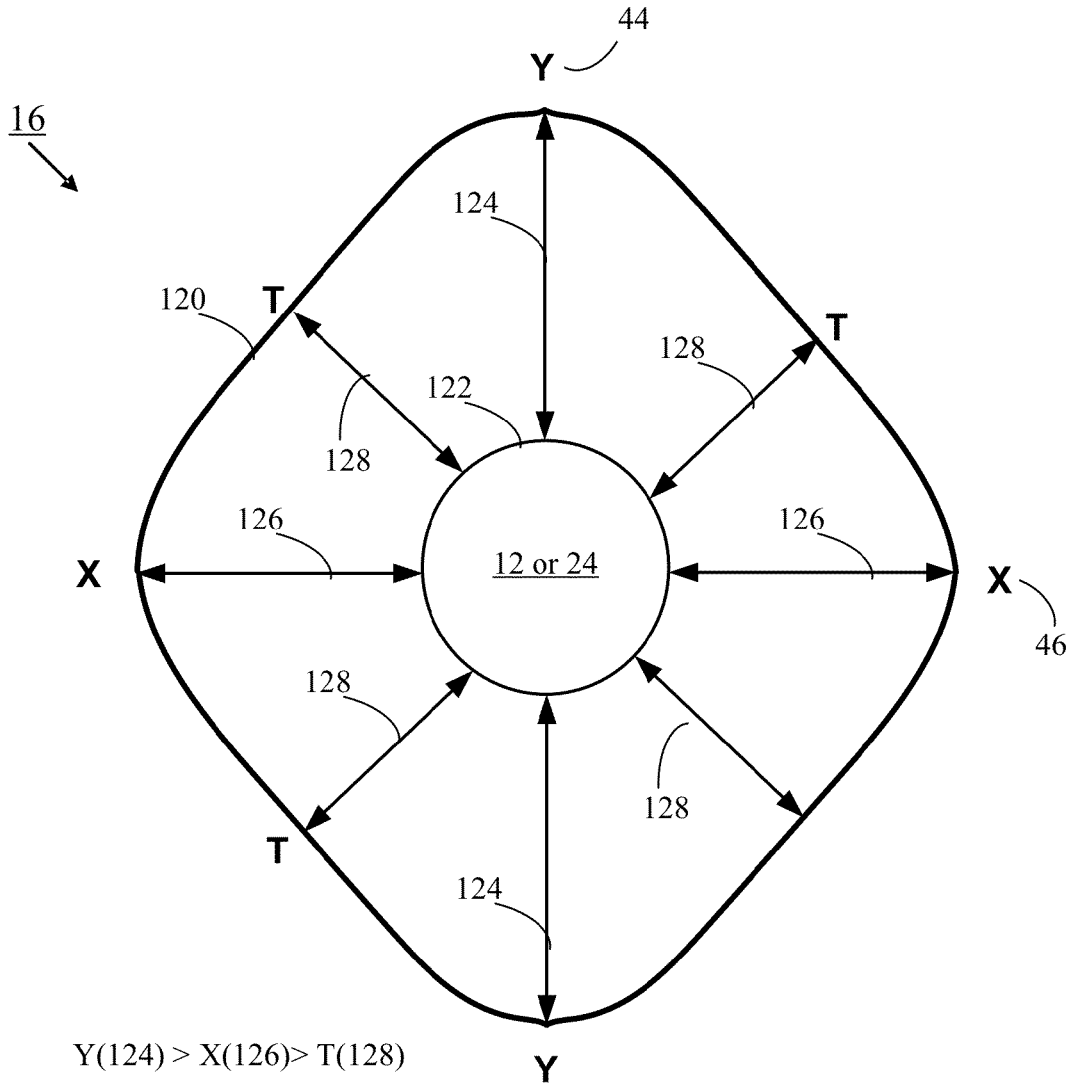
FIG. 8 is a plan view of an example of a suspension element having an outer periphery with dihedral symmetry.

As previously described, the shape of the inner periphery, outer periphery, or both of a suspension element 16 may have dihedral symmetry. FIG. 8 shows an example of a suspension element 16 (surround or spider) having an outer periphery 120 with dihedral symmetry and an inner periphery 122 with a circular shape. In this example, the distance 124 between the inner periphery 122 and the outer periphery 120 along the y-axis 44 is greater than the distance 126 between the inner periphery 122 and the outer periphery 120 along the x-axis 46. This distance 126 between the peripheries 120, 122 along the x-axis 46 is greater than the distance 128 between the peripheries 120, 122 along the minor (T) axes 130-1, 130-2. The different distances 124, 126, 128 produce a rhombus-like, diamond-like, or lozenge-like shape.

The various shapes for the suspension elements described in connection with FIGS. 5 through 8 can be particularly effective for suspension elements constructed of plain-weave fabrics. Other shapes may be used for fabrics having more than two major axes (e.g., a tri-axial weave). For example, for a tri-axial weave, the inner and/or outer periphery of the suspension element could have a shape having three-fold or six-fold rotational symmetry.

Figure 9:
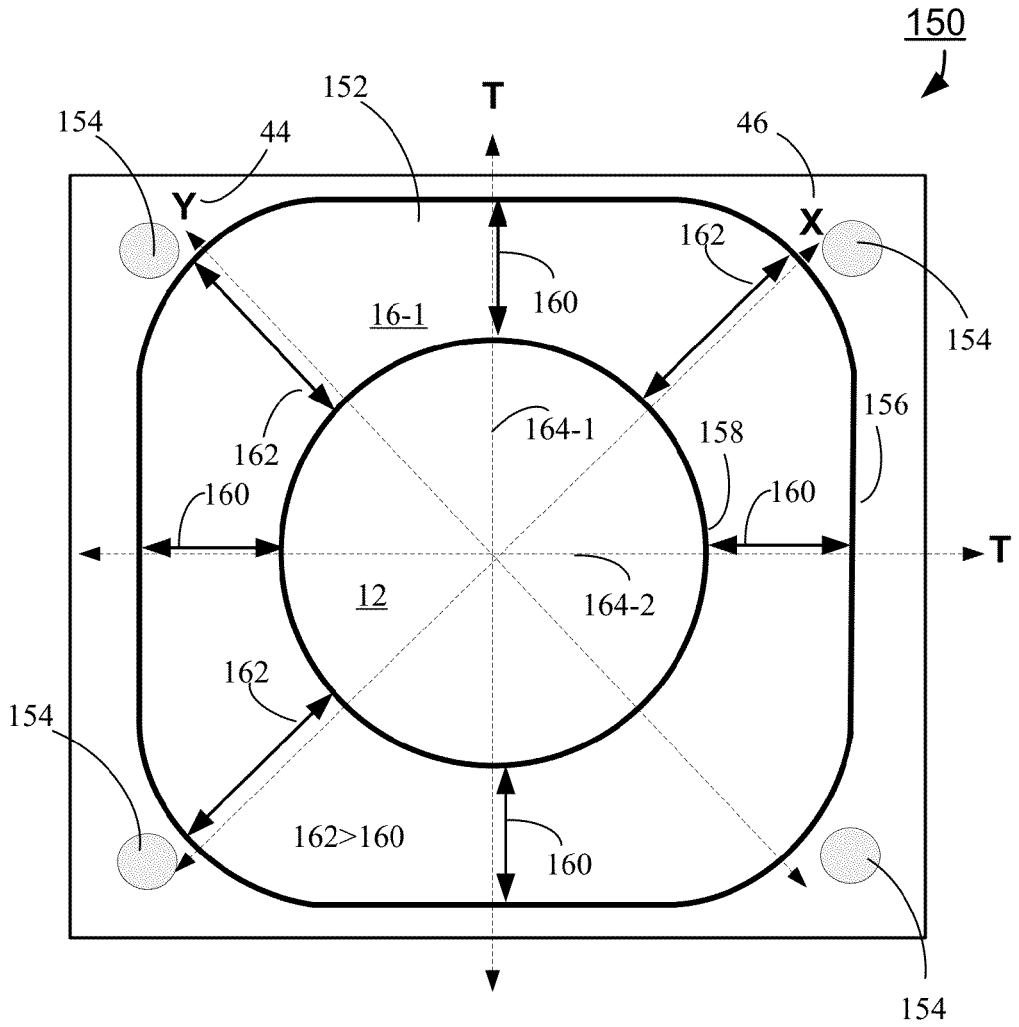
FIG. 9 is a plan view of a driver configured with a suspension element having an inner periphery that is circular in shape and an outer periphery with a shape having four-fold rotational symmetry.

FIG. 9 is a view of an example of an acoustic driver 150 configured with a surround (suspension element) 16-1. In general, the driver 150 is a transducer that converts electrical energy to sound waves. The driver 150 can be part of, for example, a loudspeaker, vehicle audio system, television, computing device, or any other electronics device that incorporates audio. The principles described herein extend to other types of drivers known in the art, examples of which include, but are not limited to, subwoofers, woofers, high-range and mid-range speakers, tweeters, minispeakers/microdrivers, or a combination thereof.

The acoustic driver 150 has a frame 152 and a plurality of mounting holes 154 by which the driver 150 can be secured to a surface, for example, a wall within an electronic device. The mounting holes 154 appear near the outer periphery 156 of the surround 16-1. The outer periphery 156 has the shape of a squircle, but could have the shape of a superellipse or other shapes having n-fold rotational symmetry, or shapes having dihedral symmetry, such as a rhombus, diamond or lozenge. In this example, the surround 16-1 has a circular inner periphery 158, but the inner periphery could be other shapes, including but not limited to an ellipse, toroid, square, rectangle, oblong, racetrack, or other non-circular shapes, or a combination thereof. The outer periphery 156 and inner periphery 158 correspond to the roll outer periphery 18-1 and roll inner periphery 18-2, respectively, of the surround 16-1. The inner periphery 158 can also have a shape of a squircle, as previously described in connection with FIG. 6. The roll outer periphery 18-1 has the squircle shape, the apex of the roll (not shown) has a circular shape or a squircle shape that is almost circular, and the roll inner periphery 18-2 has a substantially circular shape.

Advantageously, the shape of the outer periphery 156 accommodates the locations of the mounting holes 154 in the frame 152, taking advantage of extra room at the corners of the frame 152, while achieving the desired equalized axial stiffness around the suspension element 16-1. The shape of the outer periphery 156 varies the distance from the substantially circular inner periphery 158 to the outer periphery 156. In this example, the distances 160 along the minor axes 164-1, 164-2 are shorter than the distances 162 along the major axes 44, 46, which are aligned, by definition, to coincide with the warp and weft of the woven fabric of the suspension element 16-1. As previously described, this difference in the distances 160, 162 contributes to the equalization of axial stiffness around the suspension element 16-1.

A number of implementations have been described. Nevertheless, it will be understood that the foregoing description is intended to illustrate and not to limit the scope of the inventive concepts, which is defined by the scope of the claims. For example, although various aforementioned implementations are directed to apparatus with two suspension elements, it is to be understood that the principles described herein apply to acoustic apparatus with a single suspension, such as tweeters, minispeakers, and minidrivers. Other embodiments are within the scope of the following claims.

What is claimed is:

1. A suspension element for an acoustic apparatus, comprising:

a woven fabric comprising warp thread and weft thread, the warp thread extending parallel to a first major axis of the woven fabric and the weft thread extending parallel to a second major axis of the woven fabric orthogonal to the first major axis, the woven fabric further comprising an inner periphery and an outer periphery, at least one of the inner and outer peripheries having a shape with one of four-fold rotational symmetry and dihedral symmetry, a distance between the inner and outer peripheries along a minor axis of the woven fabric that extends radially between the first and second major axes being shorter than a distance between the inner and outer peripheries along at least one of the first and second major axes, wherein a deformation of the woven fabric along the minor axis is substantially the same as a deformation of the woven fabric along the at least one of the first and second major axes.

2. The suspension element of claim 1, wherein the suspension element is a surround.

3. The suspension element of claim 1, wherein the suspension element is a spider.

4. The suspension element of claim 1, wherein the shape is a superellipse.

5. The suspension element of claim 1, wherein the shape is a squircle.

6. The suspension element of claim 1, wherein the at least one of the inner and outer peripheries having the shape with one of four-fold rotational symmetry and dihedral symmetry includes the outer periphery.

7. The suspension element of claim 6, wherein the inner periphery is circular in shape.

8. The suspension element of claim 1, wherein the at least one of the inner and outer peripheries having the shape with one of four-fold rotational symmetry and dihedral symmetry includes the inner periphery.

9. The suspension element of claim 8, wherein the outer periphery is circular in shape.

10. The suspension element of claim 1, wherein the at least one of the inner and outer peripheries having a shape having one of four-fold rotational symmetry and dihedral symmetry includes the inner periphery and the outer periphery.

11. The suspension element of claim 10, wherein the shape of each periphery has a plurality of outwardly curved corners, each outwardly curved corner of one of the peripheries is approximately on the minor axis, and each outwardly curved corner of the other of the peripheries is approximately on at least one of the first and second major axes.

12. The suspension element of claim 1, wherein the woven fabric is a plain-weave cloth.

13. An acoustic apparatus, comprising:

a frame; and a suspension element comprising a first woven fabric comprising warp thread and weft thread, the warp thread extending parallel to a first major axis of the first woven fabric and the weft thread extending parallel to a second major axis of the first woven fabric orthogonal to the first major axis, the first woven fabric further comprising an inner periphery and an outer periphery coupled to the frame, at least one of the inner and outer peripheries having a shape with one of four-fold rotational symmetry and dihedral symmetry, a distance between the inner and outer peripheries along a minor axis that extends radially between the first and second major axes being shorter than a distance between the inner and outer peripheries along at least one of the first and second major axes, wherein a deformation of the first woven fabric along the minor axis is substantially the same as a deformation of the first woven fabric along the at least one of the first and second major axes.

14. The acoustic apparatus of claim 13, wherein the suspension element is a surround.

15. The acoustic apparatus of claim 13, wherein the suspension element is a spider.

16. The acoustic apparatus of claim 13, wherein the shape is a superellipse.

17. The acoustic apparatus of claim 13, wherein the shape is a squircle.

18. The acoustic apparatus of claim 13, wherein the at least one of the inner and outer peripheries having the shape with one of four-fold rotational symmetry and dihedral symmetry includes the outer periphery.

19. The acoustic apparatus of claim 18, wherein the inner periphery is circular in shape.

20. The acoustic apparatus of claim 13, wherein the at least one of the inner and outer peripheries having the shape with one of four-fold rotational symmetry and dihedral symmetry includes the inner periphery.

21. The acoustic apparatus of claim 20, wherein the outer periphery is circular in shape.

22. The acoustic apparatus of claim 13, wherein the at least one of the inner and outer peripheries having a shape having one of four-fold rotational symmetry and dihedral symmetry includes the inner periphery and the outer periphery.

23. The acoustic apparatus of claim 22, wherein the shape of each periphery has a plurality of outwardly curved corners, each outwardly curved corner of one of the peripheries is approximately on the minor axis, and each outwardly curved corner of the other periphery is approximately on at least one of the first and second major axes.

24. The acoustic apparatus of claim 13, wherein the first woven fabric is a plain-weave cloth.

25. The acoustic apparatus of claim 13, further comprising a second suspension element comprising a second woven fabric comprising warp thread and weft thread, the warp thread of the second woven fabric extending parallel to a first major axis of the second woven fabric and the weft thread of the second woven fabric extending parallel to a second major axis of the second woven fabric orthogonal to the first major axis of the second woven fabric, the second woven fabric further comprising an inner periphery and an outer periphery, at least one of the inner and outer peripheries of the second woven fabric having a shape with one of four-fold rotational symmetry and dihedral symmetry, a distance between the inner and outer peripheries of the second woven fabric along a minor axis of the second woven fabric extending radially between the first and second major axes of the second woven fabric being shorter than a distance between the inner and outer peripheries of the second woven fabric along at least one of the first and second major axes of the second woven fabric.

26. The acoustic apparatus of claim 25, wherein one of the suspension elements is a surround and the other of the suspension elements is a spider.

27. An electronics system comprising:

an acoustic apparatus with a frame and a suspension element, the suspension element comprising:

a woven fabric comprising warp thread and weft thread, the warp thread extending parallel to a first major axis of the woven fabric and the weft thread extending parallel to a second major axis of the woven fabric orthogonal to the first major axis, the woven fabric further comprising an outer periphery coupled to the frame, the outer periphery having a shape with one of four-fold rotational symmetry and dihedral symmetry, a distance along a minor axis of the woven fabric that extends radially between the first and second major axes being shorter than a distance along at least one of the first and second major axes.

28. The electronics system of claim 27, wherein the suspension element is a surround.

29. The electronics system of claim 27, wherein the suspension element is a spider.

30. The electronics system of claim 27, wherein the shape is a superellipse.

31. The electronics system of claim 27, wherein the shape is a squircle.

* * * * *